US008388317B2

(12) United States Patent
Sung

(10) Patent No.: US 8,388,317 B2
(45) Date of Patent: Mar. 5, 2013

(54) DIRECT CRANKSHAFT OF AIR COMPRESSOR

(75) Inventor: Joo-Hwan Sung, Chungcheongbuk-do (KR)

(73) Assignee: Kohands Co., Ltd., Gunseo-Myeon (KR)

( * ) Notice: Subject to any disclaimer, the term of this patent is extended or adjusted under 35 U.S.C. 154(b) by 580 days.

(21) Appl. No.: 12/516,570

(22) PCT Filed: Jun. 28, 2007

(86) PCT No.: PCT/KR2007/003144

§ 371 (c)(1),
(2), (4) Date: May 27, 2009

(87) PCT Pub. No.: WO2008/066232

PCT Pub. Date: Jun. 5, 2008

(65) Prior Publication Data

US 2010/0061866 A1 Mar. 11, 2010

(30) Foreign Application Priority Data

Nov. 27, 2006 (KR) ..... 10-2006-0117690

(51) Int. Cl.
*F04B 1/04* (2006.01)

(52) U.S. Cl. ..... 417/273; 74/445

(58) Field of Classification Search ..... 74/445; 417/313, 510; 514/479
See application file for complete search history.

(56) References Cited

U.S. PATENT DOCUMENTS

| | | | | |
|---|---|---|---|---|
| 1,726,633 | A | 9/1929 | Smith | |
| 4,190,402 | A | 2/1980 | Meece et al. | |
| 4,356,605 | A * | 11/1982 | Everts | 29/888.08 |
| 4,957,416 | A | 9/1990 | Miller et al. | |
| 6,401,472 | B2 | 6/2002 | Pollrich et al. | |
| 6,488,609 | B1 * | 12/2002 | Morimoto et al. | 477/5 |
| 2003/0072659 | A1 * | 4/2003 | Pressel | 417/510 |

FOREIGN PATENT DOCUMENTS

| | | | |
|---|---|---|---|
| JP | 54-044943 | | 4/1979 |
| JP | 58-067978 | | 4/1983 |
| JP | 2005-023788 | | 4/1983 |
| JP | 01-141384 | | 9/1989 |
| JP | 2002-227764 | A | 8/2002 |
| JP | 2006-274933 | | 10/2006 |
| KR | 10-2004-0034082 | A | 4/2004 |

OTHER PUBLICATIONS

International Search Report for PCT/KR2007/003144 mailed Sep. 13, 2007.

* cited by examiner

*Primary Examiner* — Anh Mai
*Assistant Examiner* — Brenitra Lee
(74) *Attorney, Agent, or Firm* — Christopher Paul Mitchell

(57) ABSTRACT

There is provided a direct crankshaft of an air compressor for producing compressed air in which a crankshaft is implemented by two crank plates integrally overlapped with each other so that compression cylinders can be arranged in the radial direction to exhibit an excellent air cooling performance, top dead centers and bottom dead centers of the compression cylinders are symmetrically arranged so that the cancellation between pressurizing and vacuuming phenomena and the running of a motor can be smoothly performed, and the motor is integrated with a compression pump so that various driving components such as belts, pulleys, covers, and the like are eliminated and manufacturing costs are remarkably reduced. The direct crankshaft includes crank plates integrated with each other to form an overlapping unit. The overlapping unit has a shaft coupling hole through which a motor shaft penetrates such that the direct crankshaft is directly coupled with a motor.

4 Claims, 6 Drawing Sheets

[Fig. 1]
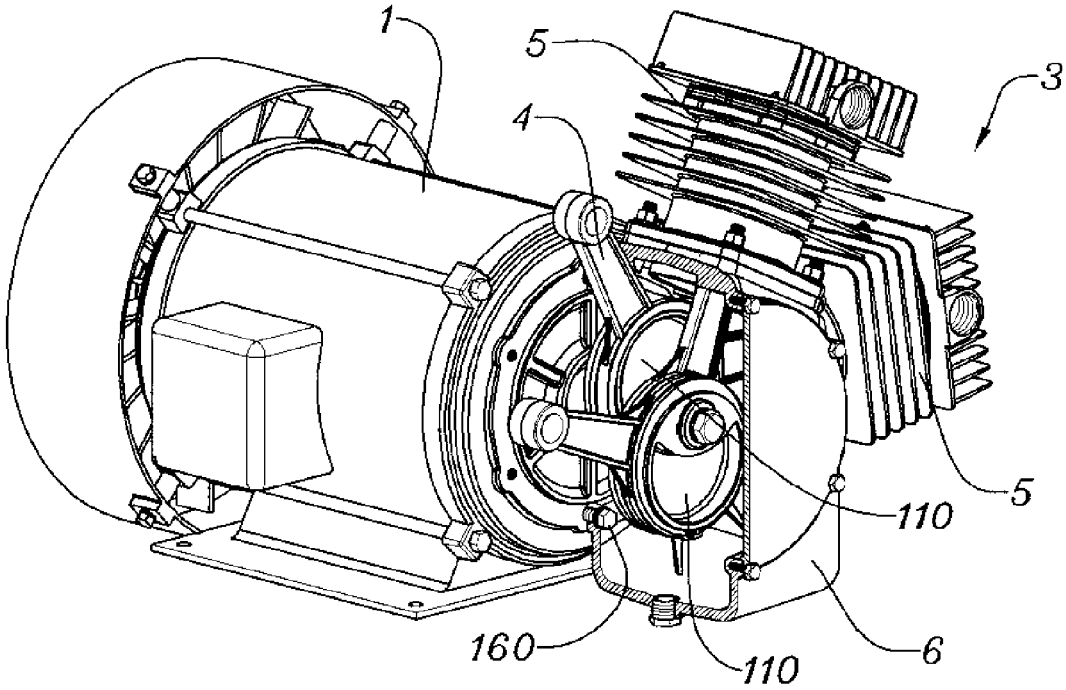
[Fig. 2]
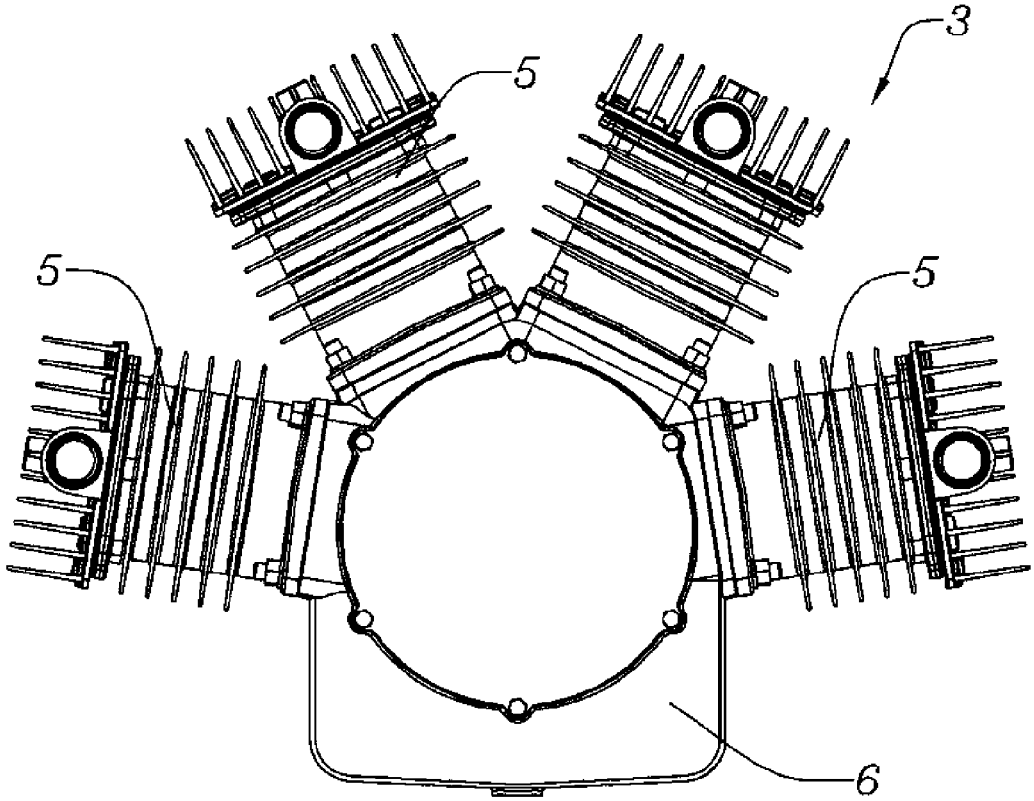

[Fig. 3]
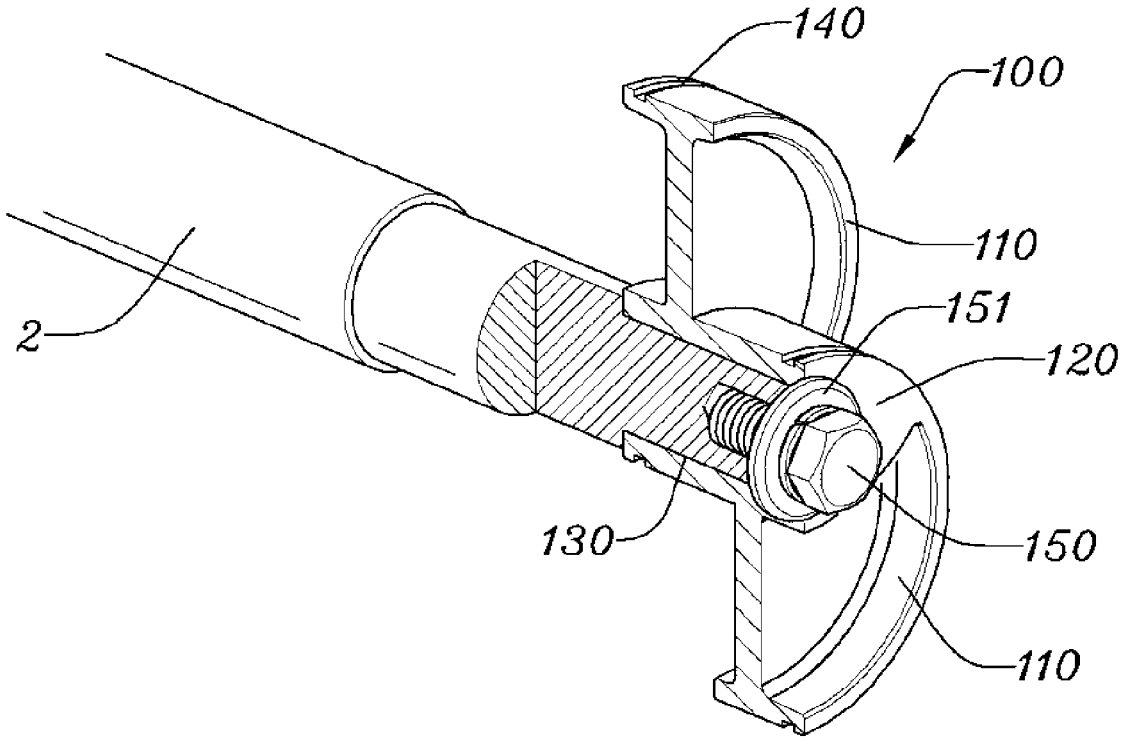

[Fig. 4]
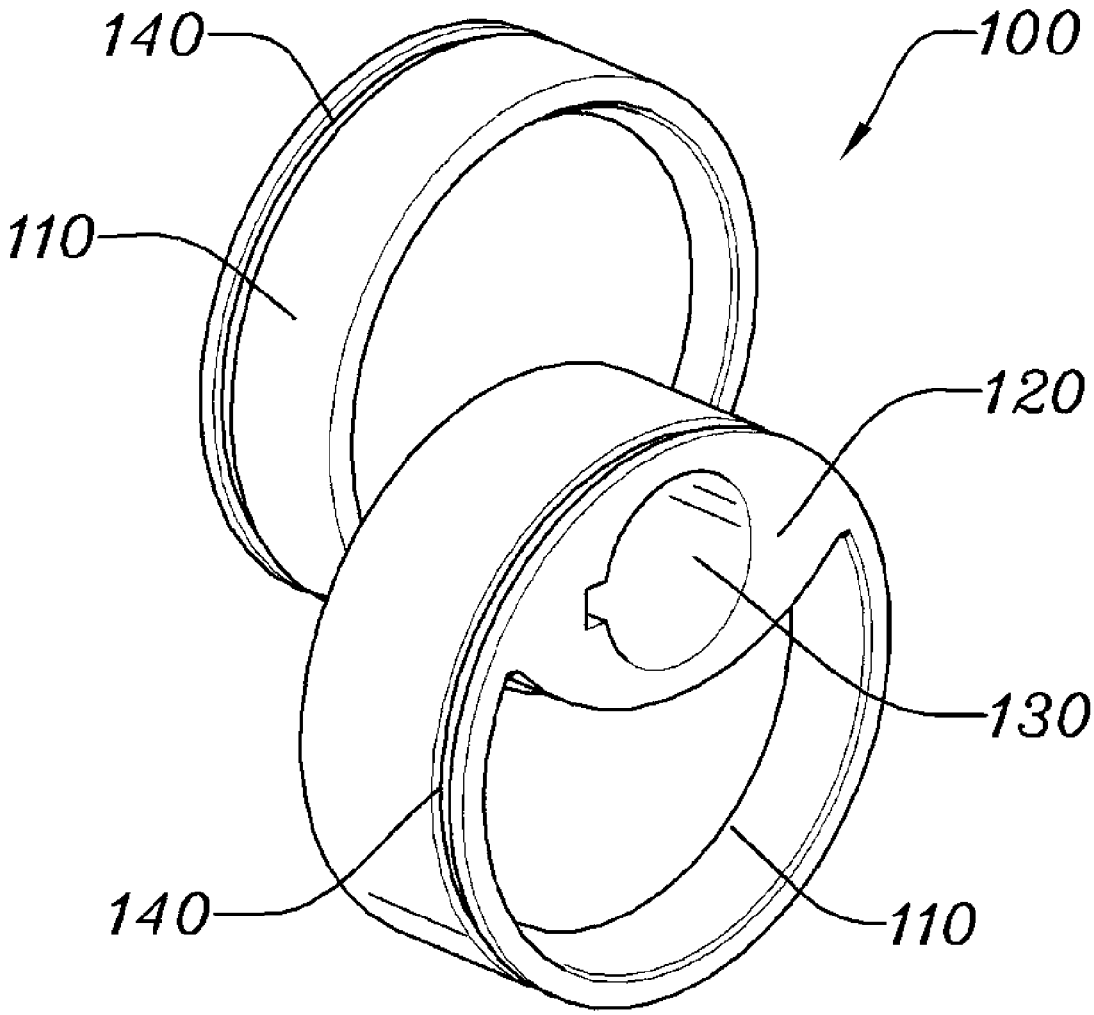

[Fig. 5]
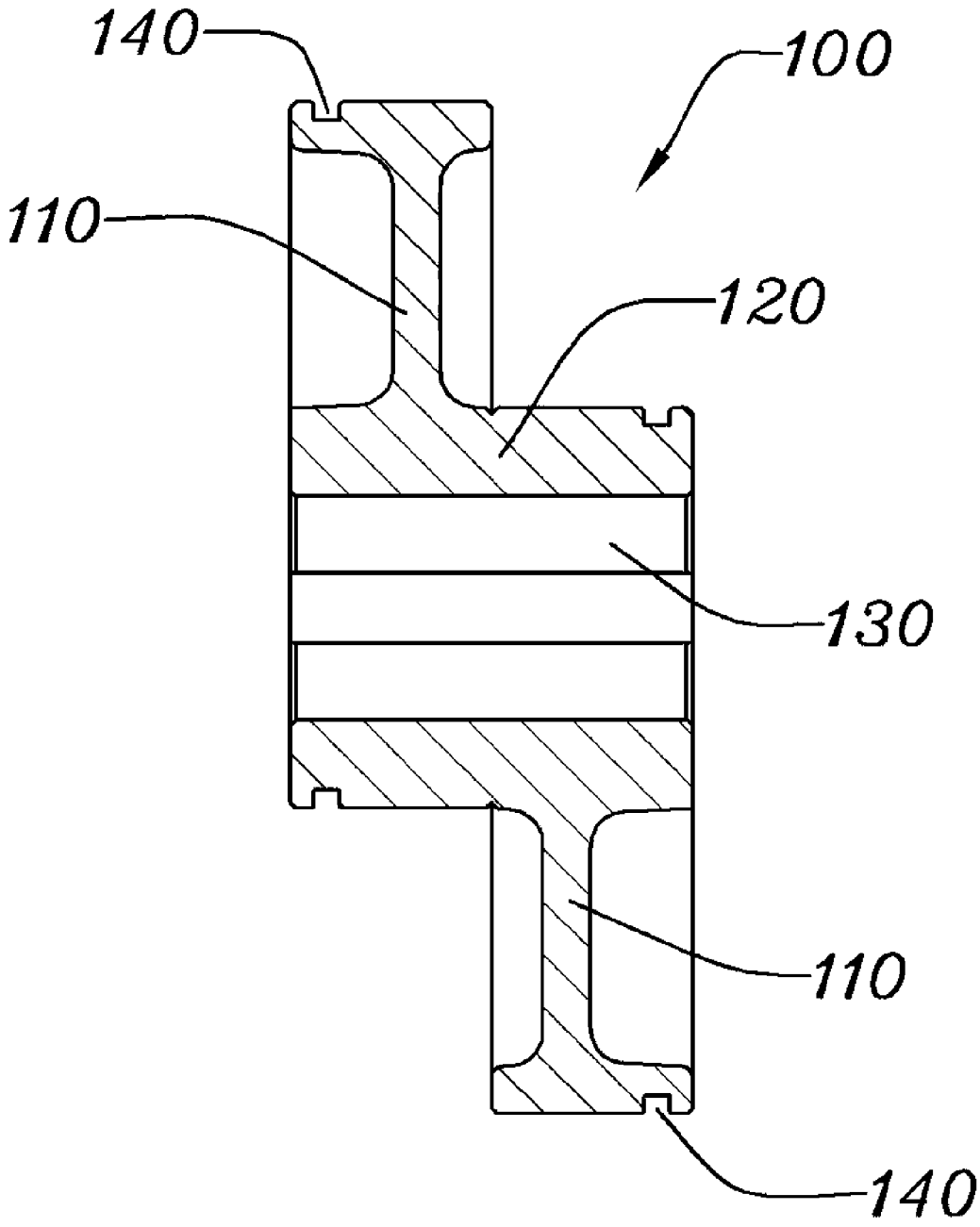

[Fig. 6]
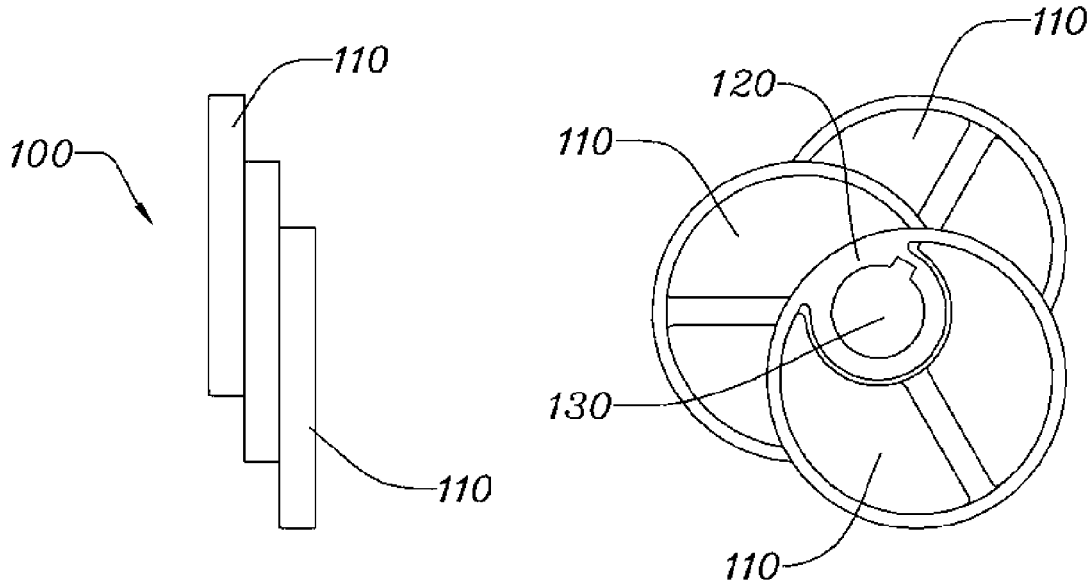
[Fig. 7]
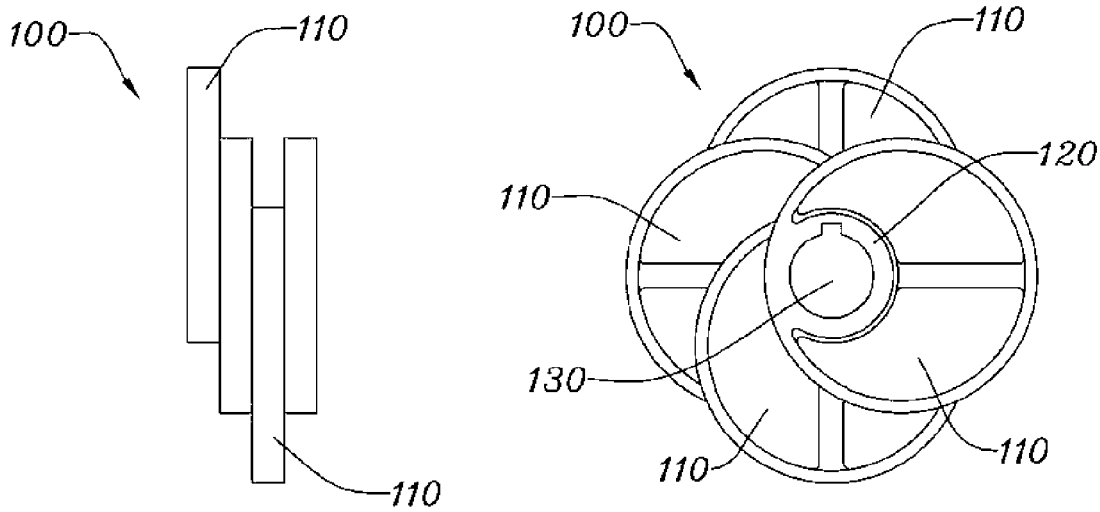

[Fig. 8]
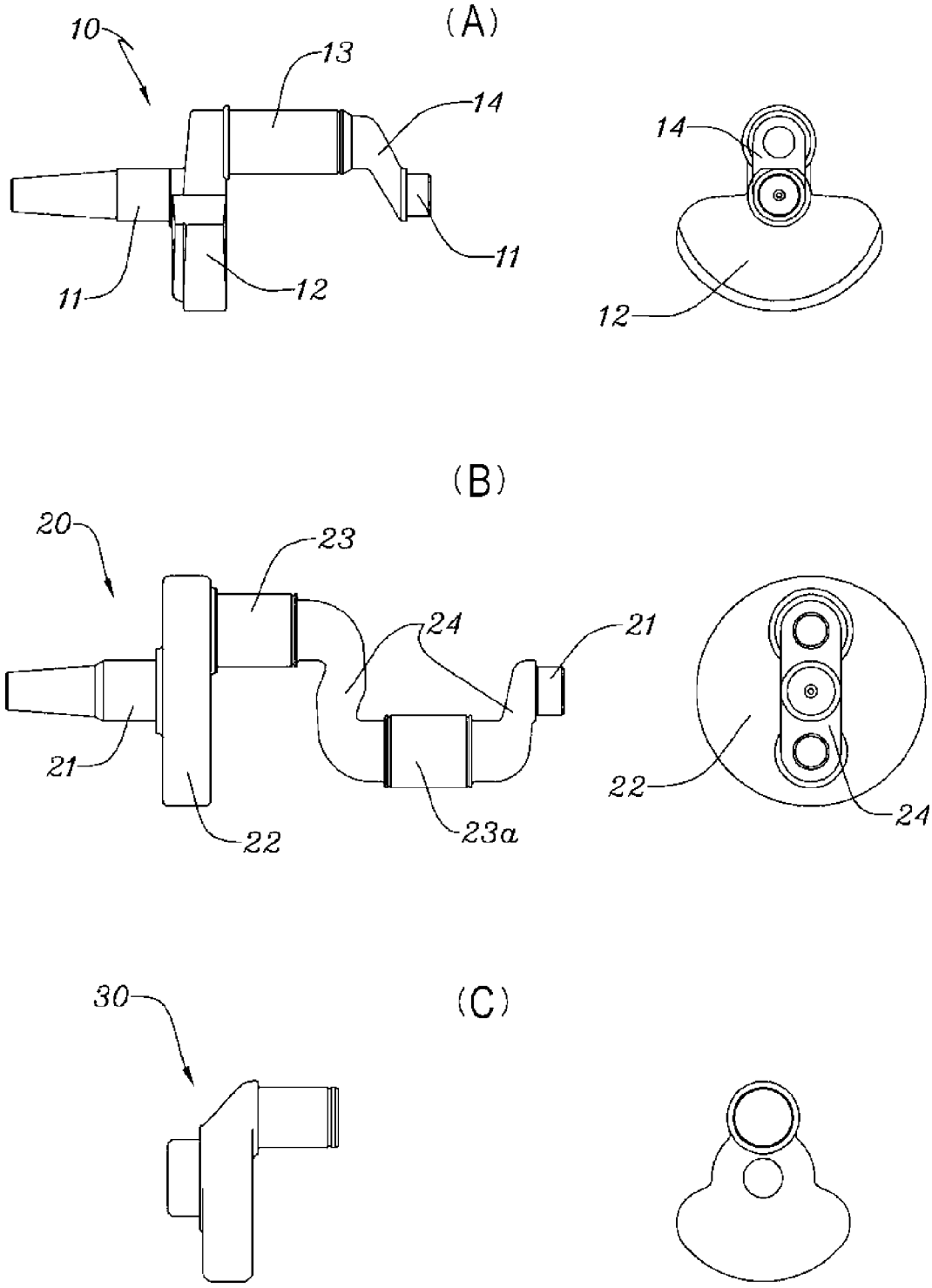

DIRECT CRANKSHAFT OF AIR COMPRESSOR

RELATED APPLICATIONS

This application is a 371 application of International Application No. PCT/KR2007/003144, filed Jun. 28, 2007, which in turn claims priority from Korean Patent Application No. 10-2006-0117690, filed Nov. 27, 2006, both of which are incorporated herein by reference.

TECHNICAL FIELD

The present invention relates to an air compressor for producing compressed air, and more particularly, to a direct crankshaft of an air compressor in which a crankshaft is implemented by two crank plates integrally overlapped with each other so that compression cylinders can be arranged in the radial direction to exhibit an excellent air cooling performance, top dead centers and bottom dead centers of the compression cylinders are symmetrically arranged so that the cancellation between pressurizing and vacuuming phenomena and the running of a motor can be smoothly performed, and the motor is integrated with a compression pump so that various driving components such as belts, pulleys, covers, and the like can be eliminated and manufacturing costs can be remarkably reduced.

BACKGROUND ART

A piston type air compressor for producing compressed air includes an air compression pump, a motor to drive the air compression pump, driving belt pulleys mounted to the motor and the air compression pump, a belt to connect the belt pulleys to each other such that the air compression pump is driven due to the rotational power of the motor.

In order to radiate and cool compression heat of the air compression pump, the belt pulley which is mounted to the air compression pump is made in the form of a fan and cooling wind is generated only when the fan-shaped belt pulley must be rotated in a predetermined direction. The driving belt and the belt pulleys are surrounded by a safety net to guarantee safety during the driving of the air compressor.

The piston type air compressor, constructed by the common components, according to the related art may be divided into one in which single type compression cylinders are arranged on a cylinder case in the radial direction and the other in which parallel type compression cylinders are arranged in a single row or multiple rows.

Here, the single type cylinders in which the compression cylinders are arranged in the radial direction, as illustrated in FIG. 8A, employs a single-pin crankshaft 10. The single-pin crankshaft 10 includes a balance weight 12 integrally formed at a leading end of a rotation shaft 11 to maintain a rotation balance of the rotation shaft 11, and a rod coupling unit 13, which is eccentrically coupled to a side of the balance weight 12 and to which bid-ends of a plurality of connecting rods connected to the insides of the respective compression cylinders are connected. The rotation shaft 11 is installed to the rod coupling unit 13 by a connecting member 14.

Thus, the plurality of the connecting rods coupled to the rod coupling unit 13 are arranged in the radial direction so that the compression cylinders are arranged in the compression pump in the radial direction and an excellent air cooling performance can exhibit.

Moreover, the parallel type cylinder, as illustrated in FIG. 8B, employs a dual-pin crankshaft 20. The dual-pin crankshaft 20 includes a balance weight 22 integrally formed at a leading end of a rotation shaft 21 to maintain a rotation balance of the rotation shaft 21, a rod coupling unit 23, which is eccentrically coupled to a side of the balance weight 22 and to which bid-ends of a plurality of connecting rods connected to the insides of the respective compression cylinders are connected, and another rod coupling unit 23*a* installed to the leading end of the rod coupling unit 23 to form a step by a connecting member 24. The rotation shaft 21 is installed to the leading end of the rod coupling unit 23*a* by the connecting member 24.

Thus, a pair of the rod coupling units 23 and 23*a* form a zigzag shape so that the top dead centers and the bottom dead centers of the connecting rods which are coupled with the rod coupling units are symmetrically arranged and the pressurizing and vacuuming phenomena can be cancelled during the running of the compression pump. Absolute load positions of the respective compression cylinders are symmetrically arranged so that excellent driving power of the motor can exhibit.

On the other hand, different from the single-pin crankshaft 10 and the dual-pin crankshaft 20, as illustrated in FIG. 8C, since a pinless crankshaft 30 is directly installed to a motor in an integrated-motor type air compressor employing the pinless crankshaft 30, the belt pulleys, the belt, and the safety net as the driving devices can be eliminated.

Consequently, since various types of crankshafts employed in the existing piston type air compressor are used only for respective air compressor suitable for features of the respective air compressors, individual effects exhibit, but the union of the above-mentioned effects cannot exhibit.

In other words, a crankshaft having all the advantages of the single-pin crankshaft, the dual-pin crankshaft, and the pinless crankshaft cannot be accomplished by the present technology, because the usual crankshaft has technical limit in employing the connecting member to connect the rod coupling units with each other and the balance weight to maintain the balance during the rotation.

DISCLOSURE OF INVENTION

Technical Problem

Therefore, the present invention has been made in view of the above problems, and it is an aspect of the present invention to provide a direct crankshaft which has all advantages of a single-pin crankshaft, a dual-pin crankshaft, and a pinless crankshaft and is directly installed to a motor, exhibits excellent air cooling effect when using the single-pin crankshaft and the single type compression cylinder, a top dead center and a bottom dead center are symmetrically arranged like in the dual-pin crankshaft and the parallel type compression cylinder so that the pressurizing and vacuuming phenomena are cancelled and a smooth driving is enabled, and the motor is integrated with a compression pump like a case of using the pinless crankshaft so that various driving components such as a belt pulley, a belt, and a safety net can be eliminated.

Advantageous Effects

As described above, according to the present invention, components such as the balance weight and the connecting member are eliminated and two crank plates are overlapped with each other to be integrated so that the direct crankshaft can be configured more compactly. Compression cylinders are arranged in the radial direction and top dead centers and bottom dead centers can be symmetrically arranged.

Thus, excellent air cooling effect can be guaranteed and the cancellation of the pressurizing and vacuuming phenomena can be obtained. Absolute load positions are symmetrically arranged so that the motor can be more smoothly driven.

Moreover, the direct crankshaft is directly connected to the motor so that various driving components such as belt pulleys, a belt, a safety net, a bearing, etc. can be eliminated, due to this, manufacturing costs can be reduced, and economic advantages can be enhanced.

BRIEF DESCRIPTION OF THE DRAWINGS

FIG. 1 is a partial sectional perspective view illustrating a compression pump employing a direct crankshaft according to an embodiment of the present invention;

FIG. 2 is a front view illustrating the direct crankshaft according to the embodiment of the present invention;

FIG. 3 is a partial sectional perspective view illustrating an assembly of the direct crankshaft according to the embodiment of the present invention and a motor shaft;

FIG. 4 is a perspective view illustrating the direct crankshaft according to the embodiment of the present invention;

FIG. 5 is a vertical sectional view illustrating the direct crankshaft according to the embodiment of the present invention;

FIGS. 6 and 7 are a front view and a side view illustrating a direct crankshaft according to another embodiment of the present invention; and FIG. 8 is front and side views illustrating crankshaft according to a related art.

EXPLANATION ON ESSENTIAL ELEMENTS OF DRAWINGS

1: motor
2: motor shaft
4: connecting rod
10: single-pin crankshaft
20: dual-pin crankshaft
30: pinless crankshaft
100: direct crankshaft
110: crank plate
120: overlapping unit
130: shaft coupling hole
140: ring recesses
150: fixing device

BEST MODE FOR CARRYING OUT THE INVENTION

These and/or other aspects and advantages of the present invention will become apparent and more readily appreciated from the following description of the embodiments. Hereinafter, embodiments of the present invention will be described in detail with reference to the accompanying drawings.

In the present invention, a compact direct crankshaft, in which a conventional standard crankshaft employed in a piston type air compressor is excluded and a balance weight and a connecting member to connect rod coupling units with each other are eliminated, is directly installed to a motor so that all individual advantages of conventional crankshafts can exhibit.

In order to achieve the aspect of the present invention, as illustrated in FIGS. 3 and 4, a direct crankshaft according to an embodiment of the present invention is implemented by which a plurality of crank plates 110 are integrated with each other to form an overlapping unit 120 and the overlapping unit 120 has a shaft coupling hole 130 into which a motor shaft 2 penetrates and is coupled.

Hereinafter, the direct crankshaft constructed as described above will be described in detail such that the direct crankshaft of the present invention can be easily made and used.

First, a direct crankshaft 100 according to an embodiment of the present invention basically includes two crank plates 110. The crank plates 110 are integrally formed to form an overlapping unit 120 with which some parts of the crank plates 110 are overlapped, so that an additional connecting member does not need. Big-ends of connecting rods 4 are directly inserted into the outer circumferences of the respective crank plates 110, and the connecting rods 4 are not separated from the crank plates 110 due to snap rings inserted into ring recesses 140 formed in the outer circumferences of the crank plates 110.

Here, one to three connecting rods 4 may be inserted into the respective crank shafts 110. The connecting rods 4 are inserted into the crank plates 110 by which a connecting rod 4 is firstly coupled with an inner crank plate 110 before connecting the direct crank shaft 100 to the motor 2, the direct crankshaft 100 is fixed to the C 2, and sequentially another connecting rod 4 is coupled with an outer crank plate 110.

On the other hand, in order to more simplify an overall structure of the air compressor, a shaft coupling hole 130 is formed to penetrate the overlapping unit 120 of the crank plates 110 such that the direct crankshaft 100 can be directly installed to the motor 1 and a fixing washer 151 and a fixing device 150 are fastened to a leading end of the motor shaft 2. Thus, the crankshaft 100 is securely integrated with the motor shaft 2.

Moreover, centers of the respective crank plates 110 are symmetrically arranged to form top dead centers and bottom dead centers, a stroke of the compression pump 3, and the connecting rods 4 coupled with the crank plates 110 are positioned at the respective top dead centers and the bottom dead centers in compression cylinders 5 such that the compression cylinders 5, as illustrated in FIGS. 1 and 2, are arranged in the radial direction to remarkably improve the air cooling effect, to cancel the pressurizing and vacuuming phenomena, and to more smoothly drive the motor.

Furthermore, the respective crank plates 110 are integrally formed with each other in a stepped shape and due to this have an identical rotation track during an eccentric rotation. Due to this, the balance can be easily maintained during the rotation and an additional balance weight does not need.

According to another aspect of the present invention, the direct crankshaft 100 according to the embodiment of the present invention, as illustrated in FIG. 1, is directly coupled with the motor 1. In order to achieve another aspect of the present invention, the compression pump 3 must be integrally fixed to the motor 1, and a cylinder case 6 of the compression pump 3 is integrally attached to a side of the motor 1 by penetrating case fixing devices 160 through the tread coupling.

On the other hand, although the direct crankshaft 100 basically includes the two crank plates 110, however the direct crankshaft 100 is not limited to this, and may be configured such that three or four crank plates 110, as illustrated in FIGS. 6 and 7, are integrally formed with each other to form the overlapping unit 120. Thus, only the different number of the crank plates 110 cannot be departed from the scope and the spirit of the present invention.

Although a few embodiments of the present invention have been shown and described, it would be appreciated by those skilled in the art that changes may be made in this embodiment without departing from the principles and spirit of the invention, the scope of which is defined in the claims and their equivalents.

The invention claimed is:

1. A direct crankshaft of an air compressor comprising:

a plurality of crank plates integrally formed with each other to form an overlapping unit, wherein the overlapping unit has a shaft coupling hole through which a motor shaft penetrates such that the direct crankshaft is directly coupled with a motor;

wherein the crank plates have centers symmetrically arranged to form a top dead center and a bottom center as a stroke of a compression pump;

wherein connecting rods coupled with the crank plates are positioned at the top dead center and the bottom dead center in compression cylinders;

wherein the crank plates are formed in the form of a stepped structure and have an identical rotation track when the crank plates eccentrically rotate about a shaft coupling hole; and wherein the connecting rods are mounted at outer circumferential portions of the crank plates.

2. The direct crankshaft of an air compressor according to claim 1, wherein two to four of the crank plates are integrally formed with each other to form the overlapping unit.

3. The direct crankshaft of an air compressor according to claim 1, wherein one to three of the connecting rods are inserted into the outer circumferential portions of the crank plates.

4. The direct crankshaft of an air compressor according to claim 1, wherein a cylinder case of a compression pump is directly attached to a side of the motor by a case fixing device penetrating the cylinder case.

* * * * *